US005971716A

United States Patent [19]

Ota et al.

[11] Patent Number: 5,971,716

[45] Date of Patent: Oct. 26, 1999

[54] VARIABLE DISPLACEMENT COMPRESSOR HAVING A MUFFLER AND A CAPACITY CONTROL VALVE MOUNTED THERETO

[75] Inventors: Masaki Ota; Masaru Hamasaki; Youichi Okadome; Hisakazu Kobayashi, all of Kariya, Japan

[73] Assignee: Kabushiki Kaisha Toyoda Jidoshokki Seisakusho, Aichi-ken, Japan

[21] Appl. No.: 08/776,563

[22] PCT Filed: Jun. 10, 1996

[86] PCT No.: PCT/JP96/01566

§ 371 Date: Jan. 31, 1997

§ 102(e) Date: Jan. 31, 1997

[87] PCT Pub. No.: WO96/41954

PCT Pub. Date: Dec. 27, 1996

[30] Foreign Application Priority Data

Jun. 9, 1995 [JP] Japan ..... 7-186148

[51] Int. Cl.[6] ..... F04B 1/32

[52] U.S. Cl. ..... 417/222.2; 417/312

[58] Field of Search ..... 417/222.2, 312, 417/228, 269, 68

[56] References Cited

U.S. PATENT DOCUMENTS 5,531,572 7/1996 Kimura et al. ..... 417/222.2
5,681,150 10/1997 Kawaguchi et al. ..... 417/222.2

FOREIGN PATENT DOCUMENTS 0330965 9/1989 European Pat. Off. .
4012015 10/1990 Germany .

*Primary Examiner*—Timothy S. Thorpe
*Assistant Examiner*—Apollo Nguyen
*Attorney, Agent, or Firm*—Morgan & Finnegan, L.L.P.

[57] ABSTRACT

A variable displacement compressor includes a compressor body (10) for compressing gas introduced from an external circuit (65) and discharging the compressed gas to the external circuit (65). A muffler (17, 23) is located between the compressor body (10) and the external circuit (65) for preventing pulsation caused by compressing gas in the compressor body (10). A displacement control valve (20) is provided for controlling the displacement of the compressor body (10). The displacement control valve (20) is mounted on a cover (18, 24) attached to the muffler (17, 23).

19 Claims, 9 Drawing Sheets

VARIABLE DISPLACEMENT COMPRESSOR HAVING A MUFFLER AND A CAPACITY CONTROL VALVE MOUNTED THERETO

BACKGROUND OF THE INVENTION

1. Field of the Invention

The present invention relates to a variable displacement compressor. More particularly, the present invention relates to a variable displacement compressor having a control valve for controlling the displacement of the compressor by controlling the pressure in the crank chamber.

2. Description of the Related Art

Vehicles typically have compressors employed in air conditioning systems. A compressor having a controllable refrigerant gas displacement is desirable for accurately controlling the interior air temperature to make the ride comfortable for the passengers. There is a type of compressor that is provided with a swash plate or a wobble plate tiltably supported on a rotary shaft. The inclination of the swash plate or the wobble plate is controlled based on the difference between the pressure in a crank chamber and the pressure in a suction chamber. The stroke of each piston is varied by the inclination of the swash plate.

Japanese Unexamined Patent Publication 2-115578 discloses such a compressor. As shown in FIG. 10, this compressor has a wobble plate 101 mounted on a rotary shaft 102 in a crank chamber 100. The wobble plate 101 is rotatable and tiltable with respect to the shaft 102. Pistons 104 are coupled to the wobble plate 101 by a rod 103. Rotation of the shaft 102 swings the plate 101 and reciprocates each pistons 104 in an associated cylinder bore 105 at a stroke corresponding to the inclination angle of the plate 101. The reciprocation of each piston 104 draws refrigerant gas into the cylinder bores 105 from the suction chamber 106. The refrigerant gas is then compressed in each cylinder bore 105 and discharged into the discharge chamber 107.

The crank chamber 100 is communicated with a chamber 110 via passages 108 and 109. An electromagnetic control valve 111 is provided in a rear housing 112 of the compressor. The inlet port of the control valve 111 is communicated with the chamber 110. The outlet of the control valve 111 is communicated with the suction chamber 106 via a passage 113. A solenoid 111*a* located in the control valve 111 is selectively excited and de-excited based on various parameters such as the temperature of the passenger compartment. The control valve 111 opens and closes a passage between the crank chamber 100 and the suction chamber 106 by exciting and de-exciting the solenoid 111*a*. In other words, the control valve 111 controls the amount of refrigerant gas flow from the crank chamber 111 into the suction chamber 106 in accordance with the temperature of the passenger compartment, thereby controlling the pressure in the crank chamber 100. Change in the crank chamber's pressure changes the difference between the pressure in the crank chamber 100 and the pressure in the suction chamber 106. Accordingly the inclination angle of the wobble plate 101 is changed. The change in the wobble plate's inclination angle changes the stroke of each piston 104. The displacement of the compressor is thus controlled.

In the above compressor, the electromagnetic control valve 111 is accommodated in an accommodating hole 114 defined in the rear housing 112. The accommodating hole 114 needs to be formed by cutting the rear housing inwardly from its surface. Accurately machining the hole 114 is extremely troublesome.

In addition, the structure of the control valve 111 varies depending upon the usage pattern of the compressor. This means that the hole 114 must be machined to fit the size and shape of the individual control valve 111 of various type. Machining of the hole 114 thus cannot be standardized. This complicates mass production of compressors having the hole 114. Further, different types of rear housings 112 having different structures are required in the assemblage of a compressor. This results in a high manufacturing cost.

An objective of the present invention is to provide a variable displacement compressor that is easy to manufacture.

Another objective of the present invention is to provide a variable displacement compressor that is suitable for mass production.

Yet another objective of the present invention is to provide a variable displacement compressor that can be manufactured for a reasonable cost.

SUMMARY OF THE INVENTION

To achieve the above objectives, a variable displacement compressor according to the present invention includes a compressor body that compresses gas drawn from the external circuit and discharges the compressed gas to the external circuit. A muffler is provided between the compressor body and the external circuit for preventing pulsation caused by compression of gas in the compressor body. A displacement control valve is provided for controlling the displacement of the compressor body. The displacement control valve is mounted on a cover attached to the muffler.

Therefore, the present invention eliminates the necessity for forming an accommodating hole in the compressor body for accommodating the displacement control valve. This simplifies the structure of the compressor body, thereby facilitating the manufacture of the compressor body. The muffler cover may mount various kinds of displacement control valves. This allows each compressor to be suitable for different usage patterns by changing the muffler cover without altering the structure of the compressor body itself.

DETAILED DESCRIPTION OF THE PREFERRED EMBODIMENTS

A first embodiment of the present invention will now be described with reference of FIGS. 1 to 8.

Figure 1:
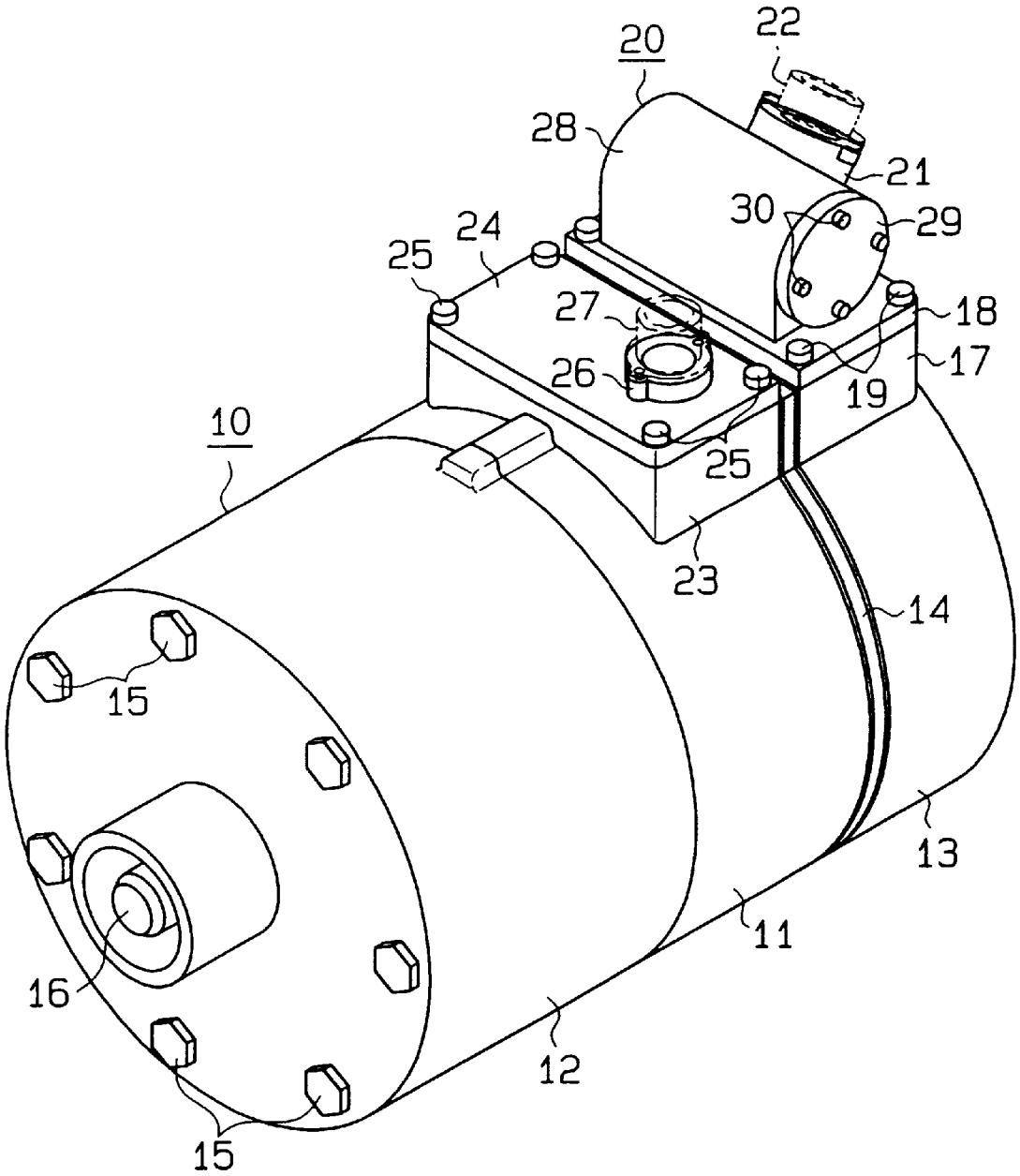
FIG. 1 is a perspective view illustrating a piston-type variable displacement compressor according to a first embodiment of the present invention.
Figure 2:
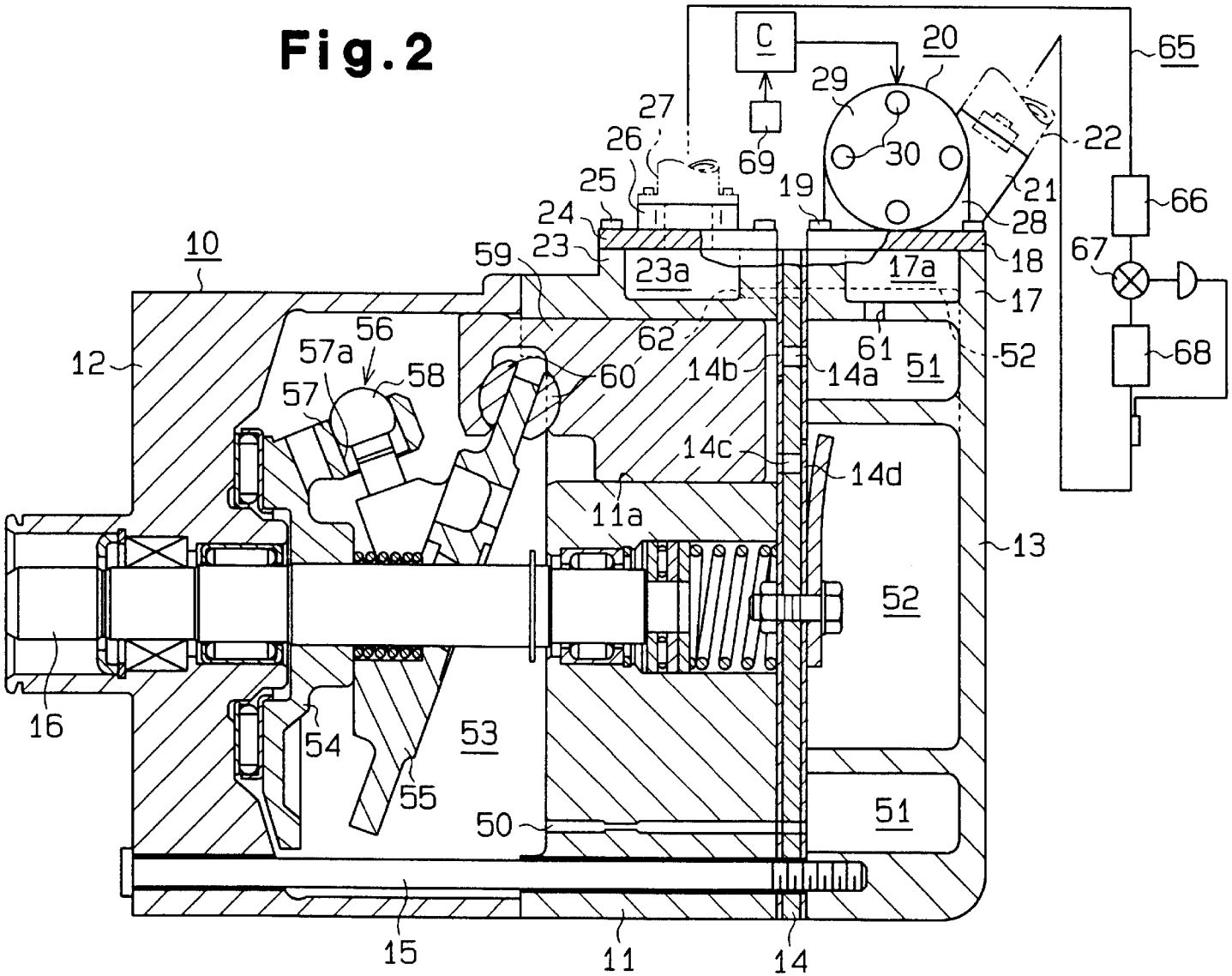
FIG. 2 is a cross-sectional view illustrating the interior of the compressor of FIG. 1.

As shown in FIGS. 1 and 2, a cylinder block 11 constitutes a part of the housing of a compressor body 10. A front housing 12 is secured to the front end face of the cylinder block 11. A rear housing 13 is secured to the rear end face of the cylinder block 11 with a valve plate 14 serving as a passage selecting means in between. A plurality of bolts 15, which extend through the front housing 12, cylinder block 11, and valve plate 14, are screwed into the rear housing 13. The bolts 15 fix the front housing 12 and the rear housing 13 to the front and rear end faces of the cylinder block 11.

A suction chamber 51 and a discharge chamber 52 are defined in the rear housing 13. The valve plate 14 has suction ports 14*a,* suction valves 14*b,* discharge ports 14*c* and discharge valves 14*d.* A crank chamber 53 is defined in the front housing 12.

A rotary shaft 16 is rotatably supported and extends through the center of the front housing 12 and the cylinder block 11. The rotary shaft 16 is connected to and rotated by an external drive source such as an engine of a vehicle. A lug plate 54 is mounted on the rotary shaft 16 and rotates integrally with the shaft 16. A swash plate 55, which serves as a drive plate, is mounted on the rotary shaft 16 in the crank chamber 53. The swash plate 55 slides along and inclines with respect to the axis of the rotary shaft 16. The swash plate 55 is coupled to the lug plate 54 by a hinge mechanism 56. The hinge mechanism 56 includes a support arm 57 formed on the lug plate 54 and a pair of guide pins 58 formed on the swash plate 55. The guide pins 58 are slidably inserted in a pair of guide holes 57*a* formed in the support arm 57. The hinge mechanism 56 rotates the swash plate 55 integrally with the rotary shaft 16. Further, the hinge mechanism 56 guides the sliding and inclining of the swash plate with respect to the axis of the rotary shaft 16.

A plurality of cylinder bores 11*a* are defined in the cylinder block 11 about the rotary shaft 16 and extend along the axis of the rotary shaft 16. A single headed piston 59 is accommodated in each cylinder bore 11*a*. The semispherical portion of a pair of shoes 60 is slidably fitted in each piston 59. The swash plate 55 is slidably held by the flat portion of each pair of shoes 60. Rotation of the swash plate 55 is converted into linear reciprocation of each piston 59 by each pair of shoes 60. Each piston 59 moves back and forth in the associated cylinder bore 11*a*. A suction stroke, in which the piston 59 moves from the top dead center position to the bottom dead center position, draws refrigerant gas in the suction chamber 51 into the cylinder bore 11*a* from the suction port 14*a* through the suction valve 14*b*. A compression stroke, in which the piston 59 moves from the bottom dead center position to the top dead center position, compresses refrigerant gas in the cylinder bore 11*a* and discharges the gas into the discharge chamber 52 from the discharge port 14*c* through the discharge valve 14*d*.

A pressure release passage 50 is defined in the cylinder block 11 and the valve plate 14 for communicating the crank chamber 53 with the suction chamber 51.

As shown in FIGS. 1 to 6, a suction muffler 17 is integrally formed on the rear housing 13. A cover 18 is fixed to the upper end of the suction muffler 17 by a plurality of screws 19 for covering a top opening of the suction muffler 17. Attaching the cover 18 to the suction muffler 17 defines a muffler chamber 17*a* in the suction muffler 17 for storing refrigerant gas. The muffler chamber 17*a* communicates with the suction chamber 51 via a bore 61. A displacement control valve 20 is mounted on the top surface of the cover 18. An inlet connection port 21, which is communicated with the muffler 17*a,* is formed projecting in a slanting direction on the outer surface of the displacement control valve 20. A suction pipe 22 of an external refrigerant circuit 65 is connected to the connection port 21. Introducing refrigerant gas from the external refrigerant circuit 65 into the suction chamber 51 via the suction muffler 17 prevents pulsation and noise of the pulsation caused by suction of refrigerant gas from the suction chamber 51 into the cylinder bores 11*a*.

A discharge muffler 23 is formed integrally on the cylinder block 11 next to the suction muffler 17. The valve plate 14 is also placed between side walls of the suction muffler 17 and the discharge muffler 23 that face each other. A cover 24 is fixed to the upper end of the discharge muffler 23 by a plurality of screws 25 for covering a top opening of the discharge muffler 23. Attaching the cover 24 to the discharge muffler 23 defines a muffler chamber 23*a* in the discharge muffler 23 for storing refrigerant gas. As shown in FIGS. 2 to 4 and FIGS. 6 to 8, the muffler chamber 23*a* communicates with the discharge chamber 52 via a discharge passage 62 defined in the cylinder block 11 and the valve plate 14. An outlet connection port 26, which is communicated with the muffler chamber 23*a,* is formed projecting on the outer surface of the cover 24. A discharge pipe 27 of the external refrigerant circuit 65 is connected to the connection port 26. Discharging refrigerant gas in the discharge chamber 52 out to the external refrigerant circuit 65 via the discharge muffler 23 prevents pulsation and noise of the pulsation caused by discharge of refrigerant gas from the cylinder bores 11*a* into the discharge chamber 52.

Figure 3:
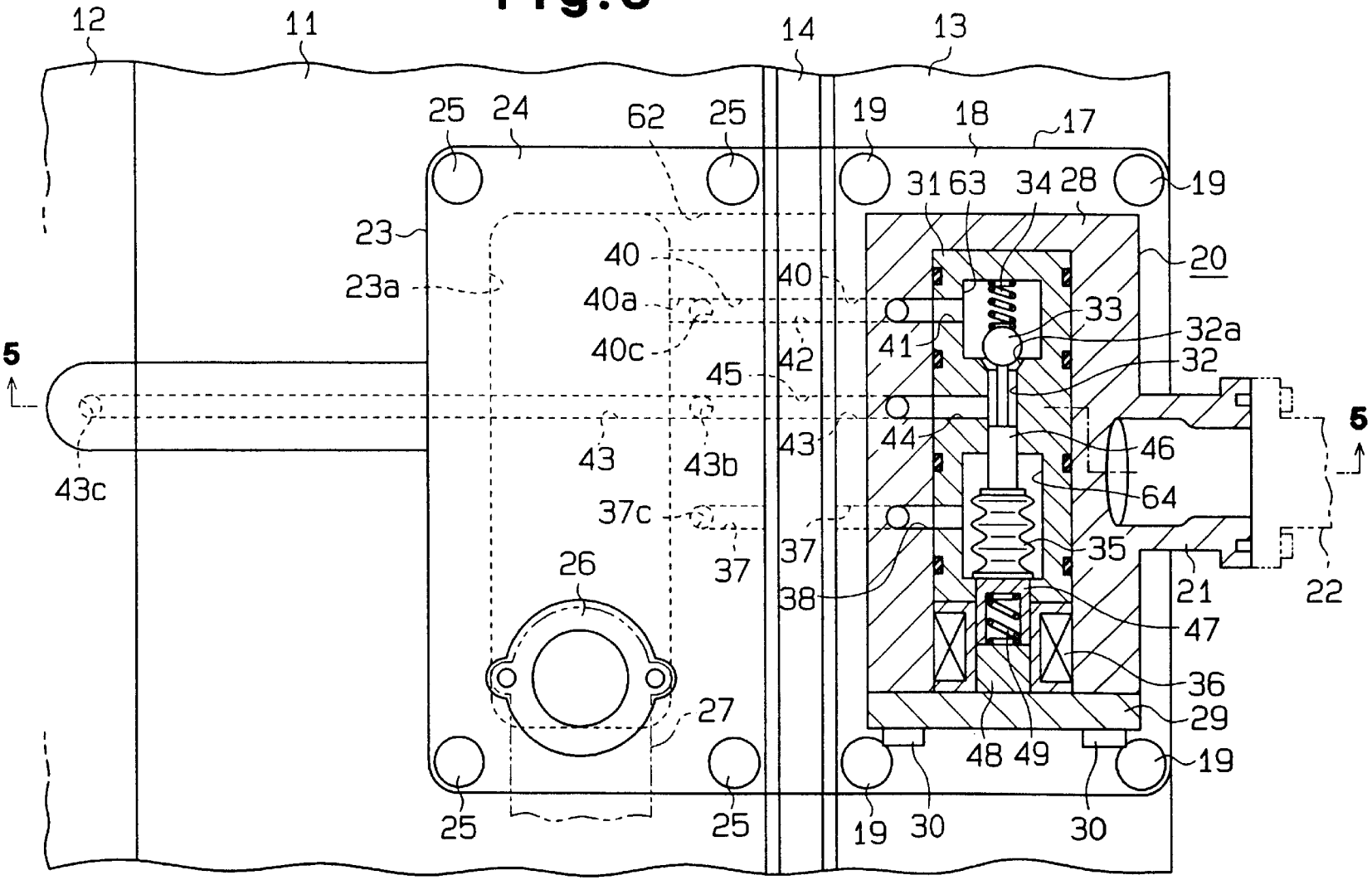
FIG. 3 is an enlarged partially cutaway plan view illustrating a part of the compressor including a displacement control valve.
Figure 4:
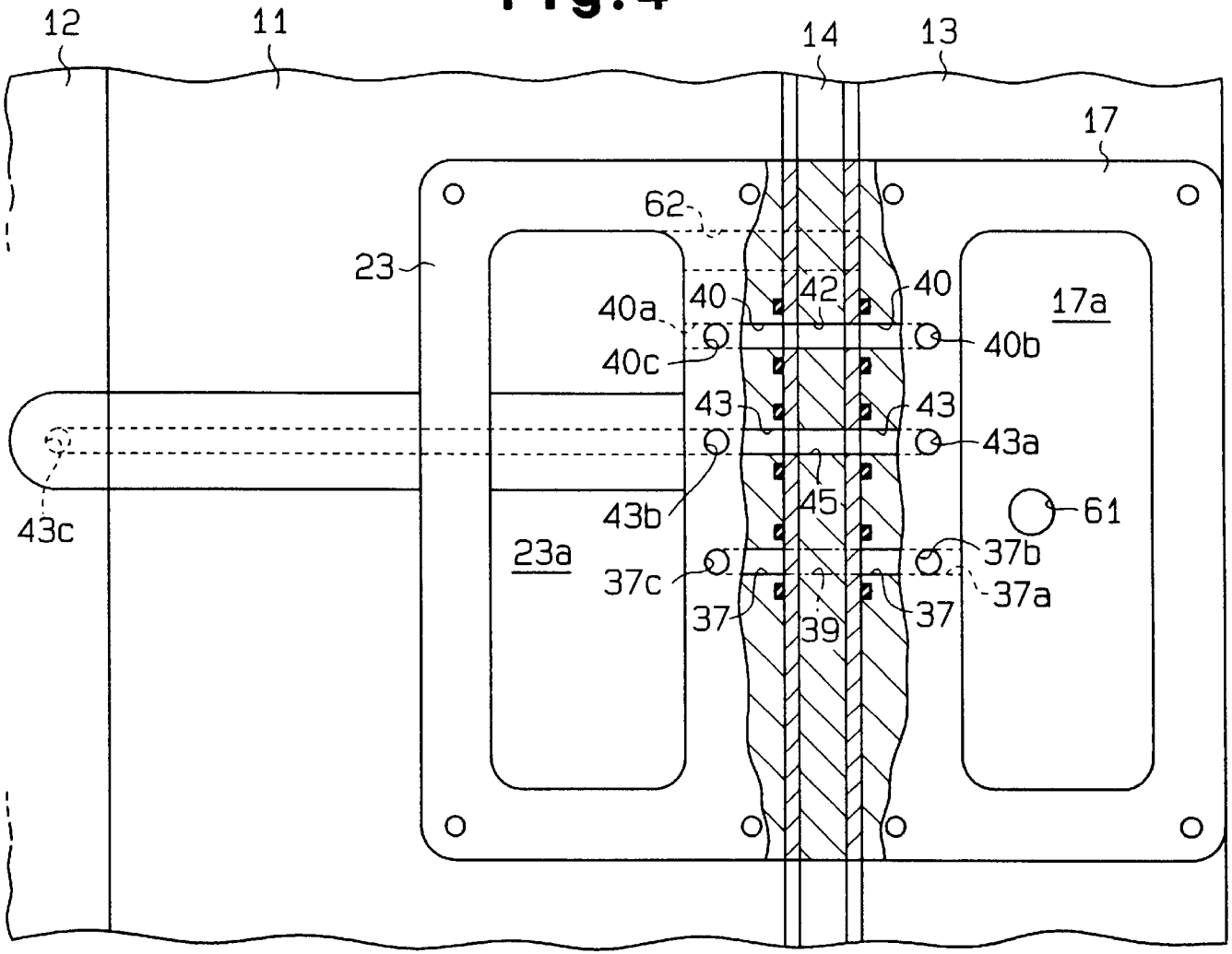
FIG. 4 is partially cutaway plan view illustrating a state in which the muffler cover seen in FIG. 3 is taken off.

As shown in FIG. 3, the displacement control valve 20 has a cylindrical casing 28 with a closed end. The casing 28 is integrally formed on the cover 18 of the suction muffler 17. A lid plate 29 is fixed to an open end of the casing 28 by a plurality of screws 30 to close the open end of the casing 28. A valve body 31 is fitted in the casing 28. A valve chamber 63, a valve hole 32 and a suction pressure detection chamber 64 are defined in the valve body 31. The valve hole 32 has an inlet port opening in the valve chamber 63. A seat 32*a* is formed around the inlet port. A spherical valve 33 is placed in the valve chamber 63 and is biased toward the seat 32*a* by a spring 34. The valve 33 closes the valve hole 32 when contacting the seat 32*a* and opens the valve hole 32 when separated away from the seat 32*a*.

A bellows 35 is provided in the suction pressure detection chamber 64. A first rod 46 and a second rod 47 are coupled to the two ends of the bellows 35, respectively. The first rod 46 has a large diameter portion and a small diameter portion. The large diameter portion of the first rod 46 is slidably inserted in the valve hole 32 for disconnecting the valve hole 32 and the detection chamber 64. The small diameter portion of the first rod 46 is inserted in the valve hole 32 and supports the valve 33 on the opposite side from the spring 34. A solenoid 36 is fixed to an end of the valve body 31 in the casing 28. An opening spring 49 is located between a fixed core 48 of the solenoid 36 and the second rod 47. The opening spring 49 biases the second rod 47 away from the fixed core 48.

When the solenoid 36 is excited, the second rod 47 contacts the fixed core 48 against the force of the opening spring 49 as shown in FIG. 3. While the solenoid 36 is excited, extension of the bellows 35 causes the first rod 46 to move the valve 33 away from the seat 32*a* against the force of the spring 34. This enlarges the opening area of the valve hole 32 defined by the valve 33. On the other hand, when the bellows 35 collapse while the solenoid 36 is excited, the valve 33 is pushed toward the seat 32*a* by the force of the spring 34. This decreases the opening area of the valve hole 32 defined by the valve 33. When the solenoid 36 is de-excited, the second rod 47 is pushed away from the fixed core 48 by the force of the opening spring 49. As a result, the valve 33 is pushed away from the seat 32*a* by the bellows 35 and the first rod 46. This maximizes the opening area of the valve hole 32 defined by the valve 33.

As shown in FIGS. 3 to 8, a first communicating passage 37 is defined in the side walls of the suction muffler 17 and the discharge muffler 23 that face each other. The first communicating passage 37 has an inlet port 37*a* opening in the muffler chamber 17*a* of the suction muffler 17 and two outlet ports 37*b*, 37*c* opening in the upper end surfaces of the side walls of the suction muffler 17 and the discharge muffler 23, respectively. A first supply passage 38 is defined in the casing 28 of the displacement control valve 20 and the valve body 31. The first supply passage 38 has an inlet port opening in the bottom surface of the cover 18 and an outlet port opening in the suction pressure detection chamber 64. Optionally, a first bore 39 may be formed in the valve plate 14 at a position corresponding to the first communicating passage 37. The first communicating passage 37 in the suction muffler 17 and the first communicating passage 37 in the discharge muffler 23 are connected only if the first bore 39 is formed. In the first embodiment of FIGS. 1–8, the first bore 39 is not formed in the valve plate 14.

In the embodiment of outlet port 37*c* of the first communicating passage 37 in the discharge muffler 23 is blocked by attaching the cover 24 on the upper end of the discharge muffler 23. Contrarily, the outlet port 37*b* of the first communicating passage 37 in the suction muffler 17 is connected to the inlet of the first supply passage 38 when the cover 18 is attached to the upper end of the suction muffler 17. Therefore, the pressure in the muffler chamber 17*a* of the suction muffler 17 (suction pressure) is introduced into the suction pressure detection chamber 64 via the first communicating passage 37 and the first supply passage 38.

A second communicating passage 40 is defined in the side walls of the suction muffler 17 and the discharge muffler 23 that face each other. The second communicating passage 40 has an inlet port 40*a* opening in the muffler chamber 23*a* of the discharge muffler 23 and two outlet ports 40*b*, 40*c* opening in the upper end surfaces of the side walls of the suction muffler 17 and the discharge muffler 23, respectively. A second supply passage 41 is defined in the casing 28 of the displacement control valve 20 and the valve body 31. The second supply passage 41 has an inlet port opening in the bottom surface of the cover 18 and an outlet port opening in the valve chamber 63. A second bore 42 is optionally formed in the valve plate 14 at a position corresponding to the second communicating passage 40. The second communicating passage 40 in the suction muffler 17 and the second communicating passage 40 in the discharge muffler 23 are connected only if the second bore 43 is formed. In the first embodiment of FIGS. 1–8, the second bore 42 is formed in the valve plate 14.

The outlet port 40*c* of the second communicating passage 40 in the discharge muffler 23 is blocked by attaching the cover 24 on the upper end of the discharge muffler 23. Contrarily, the outlet port 40*b* of the second communicating passage 40 in the suction muffler 17 is connected to the inlet of the second supply passage 41 when the cover 18 is attached to the upper end of the suction muffler 17. Therefore, the muffler chamber 23*a* of the discharge muffler 23 is communicated with the valve chamber 63 via the second communicating passage 40 and the second supply passage 41.

A third communicating passage 43 is defined in the side walls of the suction muffler 17 and the discharge muffler 23 that face each other and extends through the cylinder block 11 to the front housing 12. The third communicating passage 43 has two inlet ports 43*a*, 43*b* opening in the upper end surfaces of the side wall of the suction muffler 17 and the discharge muffler 23, respectively, and an outlet port 43*c* opening in the crank chamber 53. A third supply passage 44 is defined in the casing 28 of the displacement control valve 20 and the valve body 31. The third supply passage 44 has an inlet port opening in the valve hole 32 and an outlet port opening in the bottom surface of the cover 18. A third bore 45 is optionally formed in the valve plate 14 at a position corresponding to the third communicating passage 43. The third communicating passage 43 in the suction muffler 17 and the third communicating passage 43 in the discharge muffler 23 are connected only if the third bore 45 is formed. In the first embodiment of FIGS. 1–8, the third bore 45 is formed in the valve plate 14.

The inlet port 43*b* of the third communicating passage 43 in the discharge muffler 23 is blocked by attaching the cover 24 on the upper end of the discharge muffler 23. Contrarily, the inlet port 43*a* of the third communicating passage 43 in the suction muffler 17 is connected to the outlet port of the third supply passage 44 when the cover 18 is attached to the upper end of the suction muffler 17. Therefore, the crank chamber 53 is communicated with the valve hole 32 via the third communicating passage 43 and the third supply passage 44.

The above first to third communicating passages 37, 40, 43 and the first to third supply passages 38, 41, 44 form passages between the compressor body 10 and the displacement control valve 20 for conducting refrigerant gas.

As shown in FIG. 2, the external refrigerant circuit 65 connects the inlet connection port 21 of the suction muffler 17 with the outlet connection port 26 of the discharge muffler 23. The external refrigerant circuit 65 includes a condenser 66, an expansion valve 67 and an evaporator 68. A controller C excites/de-excites the solenoid 36 of the control valve 20 based on the ON/OFF position of an actuation switch 69 designed for actuating the air conditioning device.

The operation of the above variable displacement compressor will now be described.

Rotating the rotary shaft 16 with an external drive source such as a vehicle's engine rotates the swash plate 55 integrally with the shaft 16. The rotation of the swash plate 55 is converted into reciprocation of each piston 59 in the associated cylinder bore 11*a* by the shoes 60. Each piston 59 reciprocates with a stroke corresponding to the inclination angle of the swash plate 55. The reciprocation of each piston 59 draws refrigerant gas from the external refrigerant circuit 65 into each cylinder bore 11*a* via the suction muffler 17 and the suction chamber 51. The refrigerant gas is then compressed in the cylinder bores 11*a* and discharged out to the external refrigerant circuit 65 via the discharge chamber 52 and the discharge muffler 23.

The pressure in the muffler chamber 17*a* of the suction muffler 17 (suction pressure) is introduced into the suction pressure detection chamber 64 in the displacement control valve 20 via the first communicating passage 37 and the first supply passage 38. Therefore, with the solenoid 36 of the control valve 20 excited, when the cooling load is decreased by a continual operation of the compressor and the suction pressure is lowered, the pressure in the detection chamber 64 is lowered and the bellows 35 in the control valve 20 is extended. Accordingly, the valve 33 moves away from the seat 32*a* against the force of the spring 34, thereby enlarging the opening area of the valve hole 32. This increases the volume of refrigerant gas flow into the crank chamber 53 from the muffler chamber 23*a* of the discharge muffler 23 via the second communication passage 40, the second supply passage 41, the valve chamber 63, the valve hole 32, the third supply passage 44 and the third communicating passage 43. Therefore, the pressure in the crank chamber 53 is increased. Also, since the pressure in the suction chamber 51 is low, the difference between the pressure in the crank chamber 53 and the pressure in the cylinder bore 11*a* with the piston 59 in between is increased. This decreases the inclination angle of the swash plate 55, thereby decreasing the displacement of the compressor.

On the other hand, with the solenoid 36 of the control valve 20 excited, when the cooling load is increased and the suction pressure is increased, the pressure in the detection chamber 64 is also increased and the bellows 35 in the control valve 20 is collapsed. Accordingly, the valve 33 moves toward the seat 32*a* by the force of the spring 34 and decreases the opening area of the valve hole 32. This decreases the volume of refrigerant gas flow into the crank chamber 53 from the muffler chamber 23*a* of the discharge muffler 23. Refrigerant gas in the crank chamber 53 constantly flows into the suction chamber 51 via the pressure release passage 50. Therefore, the pressure in the crank chamber 53 is decreased. Also, since the pressure in the suction chamber 51 is high, the difference between the pressure in the crank chamber 53 and the pressure in the cylinder bore 11*a* with the piston 59 in between is decreased. This increases the inclination angle of the swash plate 55, thereby increasing the displacement of the compressor.

When the solenoid 36 of the control valve 20 is de-excited, the second rod 47 moves away from the fixed core 48 and the opening area of the valve hole 32 defined by the valve 33 is maximized. Accordingly, the pressure in the crank chamber 53 becomes extremely high and the inclination angle of the swash plate 55 becomes minimized. This causes the displacement of the compressor to be extremely small.

The controller C excites the solenoid 36 of the control valve 20 when the actuation switch 69 is turned ON. The controller C de-excites the solenoid 36 of the control valve 20 when the actuation switch 69 is turned OFF or when an abnormal condition such as a sudden change in the rotation speed of the external drive force occurs. Further, the control valve 20 controls the volume of refrigerant gas flow from the muffler chamber 23*a* of the discharge muffler 23 into the crank chamber 53 based on the suction pressure, which indicates the cooling load, thereby controlling the pressure in the crank chamber 53. Change in the pressure in the crank chamber 53 changes the difference between the pressure in the crank chamber 53 acting on the front end face of the piston 59 (the surface on the left of FIG. 2) and the pressure in the cylinder bore 11*a* acting on the rear face of the piston 59 (the surface on the right of FIG. 2), thereby changing the inclination angle of the swash plate 55. The change in the inclination angle of the swash plate 55 changes the stroke of the pistons 59. Accordingly, the displacement of the compressor is controlled. In this manner, the control valve 20 adequately controls the displacement of the compressor based on the cooling load.

In the embodiment of FIGS. 1–8, the control valve 20 for controlling the displacement is mounted on the cover 18 of the suction muffler 17. Therefore, unlike prior art compressors, the compressor according to this embodiment requires no accommodating holes in the rear housing 13 for accommodating the displacement control valve. The structure of the rear housing 13 is thus simplified and machining of the rear housing is therefore facilitated.

When various types of displacement control valves 20 for a compressor are available, various types of the cover 18 of the suction muffler 17 for mounting the various types of the displacement control valves 20 are provided. This eliminates the necessity for changing the structure of the compressor body 10 in accordance with the usage pattern of the compressor. Instead, only the cover 18 of the suction muffler 17 needs to be replaced with another type. Therefore, unlike prior art compressors, the size or the shape of the accommodating hole formed in the rear housing or the structure of the rear housing itself need not be changed in accordance with the type of displacement control valve used in the compressor of the present invention. This embodiment thus facilitates the mounting of various types of displacement control valve 20 on a compressor, thereby facilitating mass production of the compressor. Accordingly, the manufacturing costs of the compressor are decreased.

Further, in this embodiment, a gas passage formed between the compressor body 10 and the displacement control valve 20 conducts gas needed for displacement control by the control valve 20. Therefore, even when the displacement control valve 20 is mounted on the outer surface of the cover 18 of the suction muffler 17, displacement control by the displacement control valve 20 is performed without difficulty.

In addition, the connection ports 21, 26 are formed on the covers 18, 24 of the mufflers 17, 23, respectively. The pipes 22, 27 of the external refrigerant circuit are connected to the connection ports 21, 26, respectively.

This allows refrigerant gas to be drawn from the external refrigerant circuit 65 into the compressor body 10 and to be discharged from the compressor body 10 to the external refrigerant circuit 65. The orientation and the attaching position of the pipes 22, 27 may vary depending on the type of the vehicle on which the compressor is mounted. To accomodate variations, only the covers 18, 24 need to be replaced with ones having connection ports 21, 26 of different direction and position.

A second embodiment of the present invention will now be described with reference to FIG. 9. In this embodiment, a displacement control valve 20 having essentially the same structure as that of the first embodiment is mounted on the top surface of the cover 24 of the discharge muffler 23. The outlet connection port 26 is formed projecting from the outer surface of the displacement control valve 20. The discharge pipe 27 of the external refrigerant circuit 65 is connected to the port 26. The inlet connection port 21 is formed projecting from the top surface of the cover 18 of the suction muffler 17. A suction pipe 22 of the external refrigerant circuit 65 is connected to the port 21.

Figure 9:
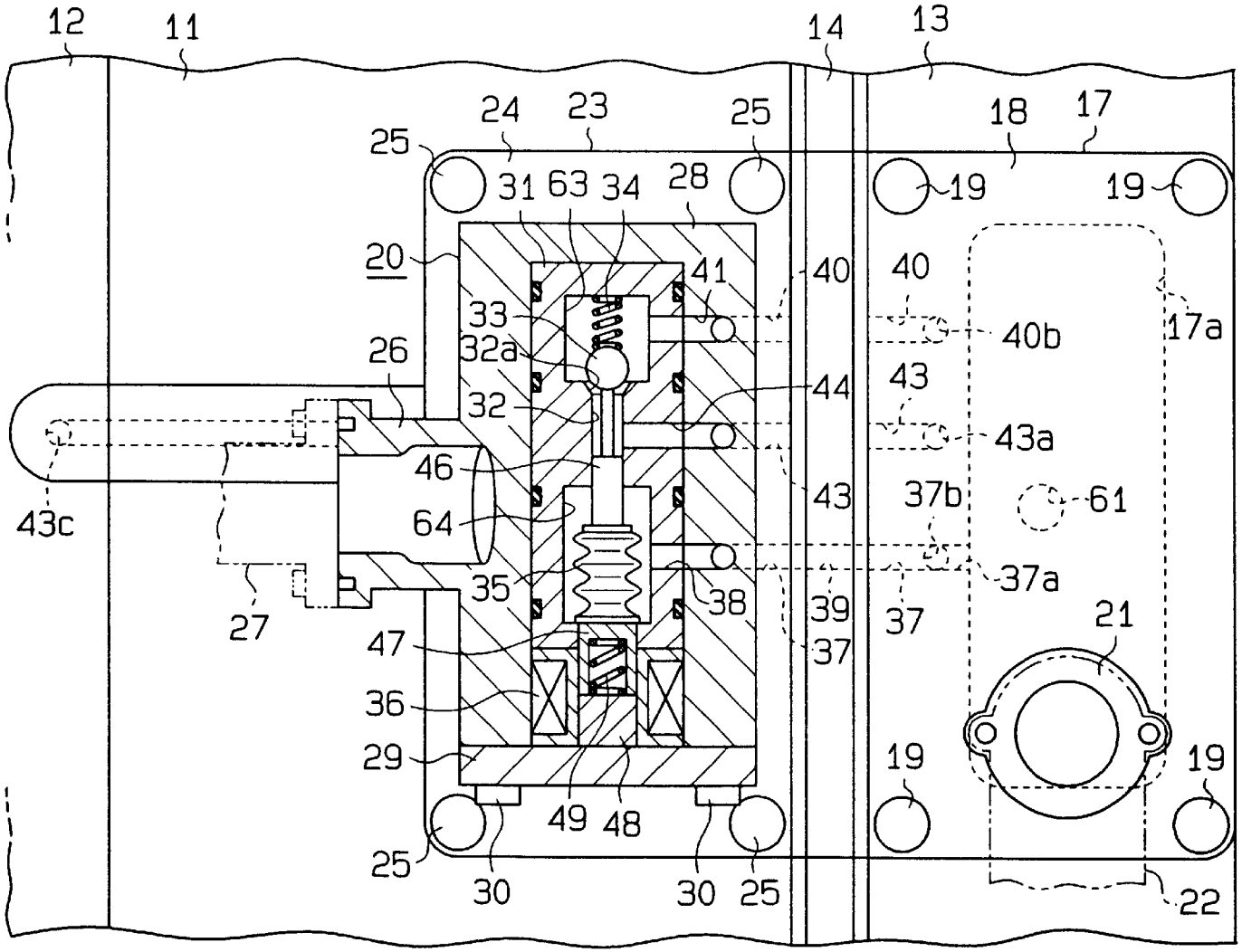
FIG. 9 is a partially cutaway plan view illustrating a main part of a second embodiment of the present invention.
Figure 10:
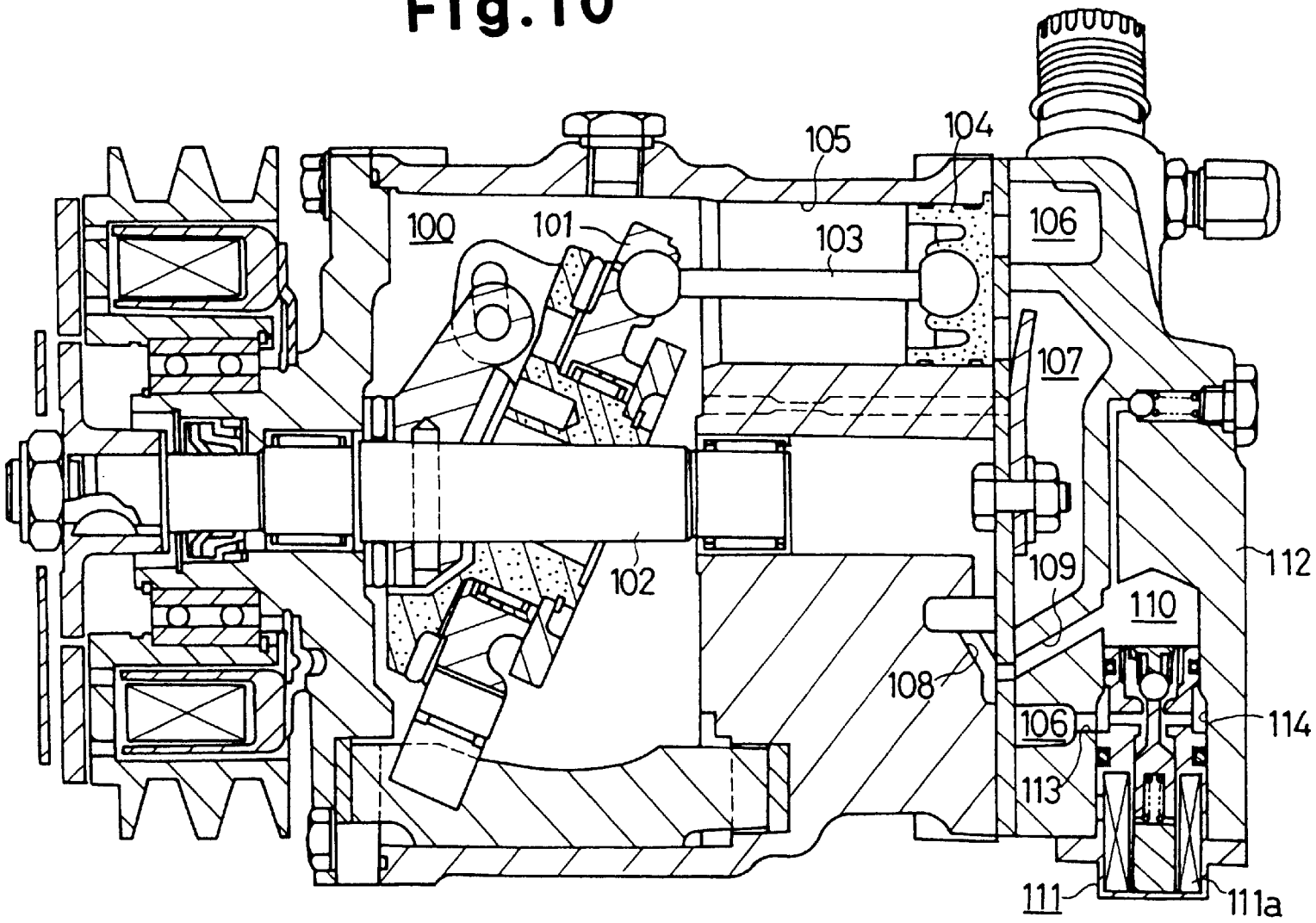
FIG. 10 is a cross-sectional view illustrating a prior art piston-type variable displacement compressor.

In the second embodiment of FIG. 9, the first bore 39 is formed in the valve plate 14 for connecting the first communicating passage 37 in the suction muffler 17 with the first communicating passage 37 in the discharge muffler 23. The second bore 42 and the third bore 45 are not formed in the valve plate 14. Therefore, the second communicating passage 40 in the suction muffler 17 is disconnected from the second communicating passage 40 in the discharge muffler 23 by the valve plate 14. Further, the third communicating passage 43 in the suction muffler 17 is disconnected from the third communicating passage 43 in the discharge muffler 23 by the valve plate 14.

The outlet port 37*b* of the first communicating passage 37 in the suction muffler 17 is blocked by attaching the cover 18 to the upper end of the suction muffler 17. Contrarily, the outlet port 37*c* of the first communicating passage 37 in the discharge muffler 23 is connected to the inlet port of the first supply passage 38 when the cover 24 is attached to the upper end of the discharge muffler 23. Therefore, the pressure in the muffler chamber 17*a* of the suction muffler 17 (suction pressure) is communicated with the suction pressure detection chamber 64 via the first communicating passage 37 and the first supply passage 38.

The outlet port 40*b* of the second communicating passage 40 in the suction muffler 17 is blocked by attaching the cover 18 to the upper end of the suction muffler 17. Contrarily the outlet port 40*c* of the second communicating passage 40 in the discharge muffler 23 is connected to the inlet port of the second supply passage 41 when the cover 24 is attached to the upper end of the discharge muffler 23. Therefore, the muffler chamber 23*a* of the discharge muffler 23 is communicated with the valve chamber 63 via the second communicating passage 40 and the second supply passage 41.

The inlet port 43*a* of the third communicating passage 43 in the suction muffler 17 is blocked by attaching the cover 18 to the upper end of the suction muffler 17. Contrarily the inlet port 43*b* of the third communicating passage 43 in the discharge muffler 23 is connected to the outlet port of the third communicating passage 44 when the cover 24 is attached to the upper end of the muffler 23. Therefore, the crank chamber 53 is communicated with the valve hole 32 via the third communicating passage 43 and the third supply passage 44.

The above structure allows the control valve 20 mounted on the cover 24 of the discharge muffler 23 to control the amount of refrigerant gas flow from the muffler chamber 23*a* of the discharge muffler 23 into the crank chamber 53 based on the suction pressure, which represents the cooling load. Accordingly, the pressure in the crank chamber 53 is controlled. Therefore, in the second embodiment, as in the first embodiment, the displacement of the compressor is adequately controlled by the control valve 20.

In this embodiment, as in the first embodiment, the compressor requires no accommodating hole for accommodating the displacement control valve in the rear housing. The structure of the rear housing 13 is thus simplified and machining thereof is therefore facilitated. In addition, when a different type of control valve is mounted on the compressor, the rear housing 13 requires no replacement. Instead, only the cover 24 of the discharge muffler 23 needs to be replaced with another type. Further, even when the displacement control valve 20 is mounted on the outer surface of the cover 24 of the discharge muffler 23, refrigerant gas is passed through the gas passage defined in the compressor 10 and the displacement control valve 20. Therefore, displacement control by the displacement control valve 20 is performed without difficulty. Other operations and effects of the second embodiment are the same as those of the first embodiment.

When mounting a compressor on a vehicle, conditions of the mounting space may vary depending on the vehicle's type. However, in the above first and second embodiments, the displacement control valve 20 may optionally be mounted on the cover 18 of the suction muffler 17 or the cover 24 of the discharge muffler 23 according to the mounting conditions of the vehicle.

When the displacement control valve 20 is mounted on the cover 18 of the suction muffler 17 or the cover 24 of the discharge muffler 23, the first to third bores 39, 42, 45 are optionally formed in the valve plate 14 in accordance with the mounting position of the valve 20. This eliminates the necessity for special machining for the cylinder block 11 and the rear housing 13, thereby enabling standardization of the cylinder block 11 and the rear housing 13. Therefore, changing the mounting position of the displacement control valve 20 does not increase the manufacture cost.

The present invention may be embodied in the following modified forms.

(1) In the first embodiment, the displacement control valve 20 may be mounted on the inner surface of the cover 18 of the suction muffler 17.

(2) In the second embodiment, the displacement control valve 20 may be mounted on the inner surface of the cover 24 of the discharge muffler 23.

(3) In each embodiment, the internal structure of the displacement control valve 20 may be modified as necessary.

Figure 5:
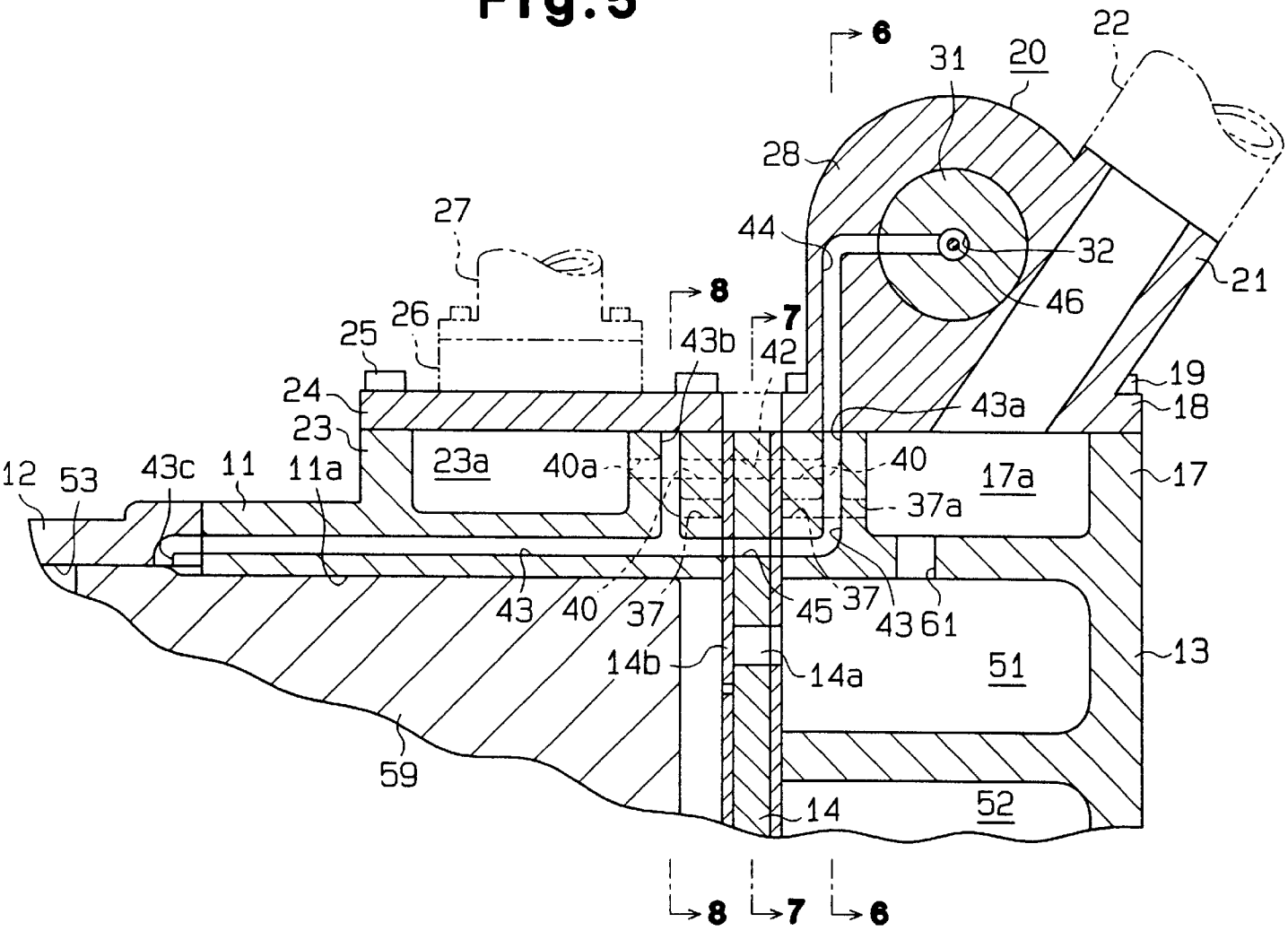
FIG. 5 is a cross-sectional view taken along line 5—5 of FIG. 3.
Figure 6:
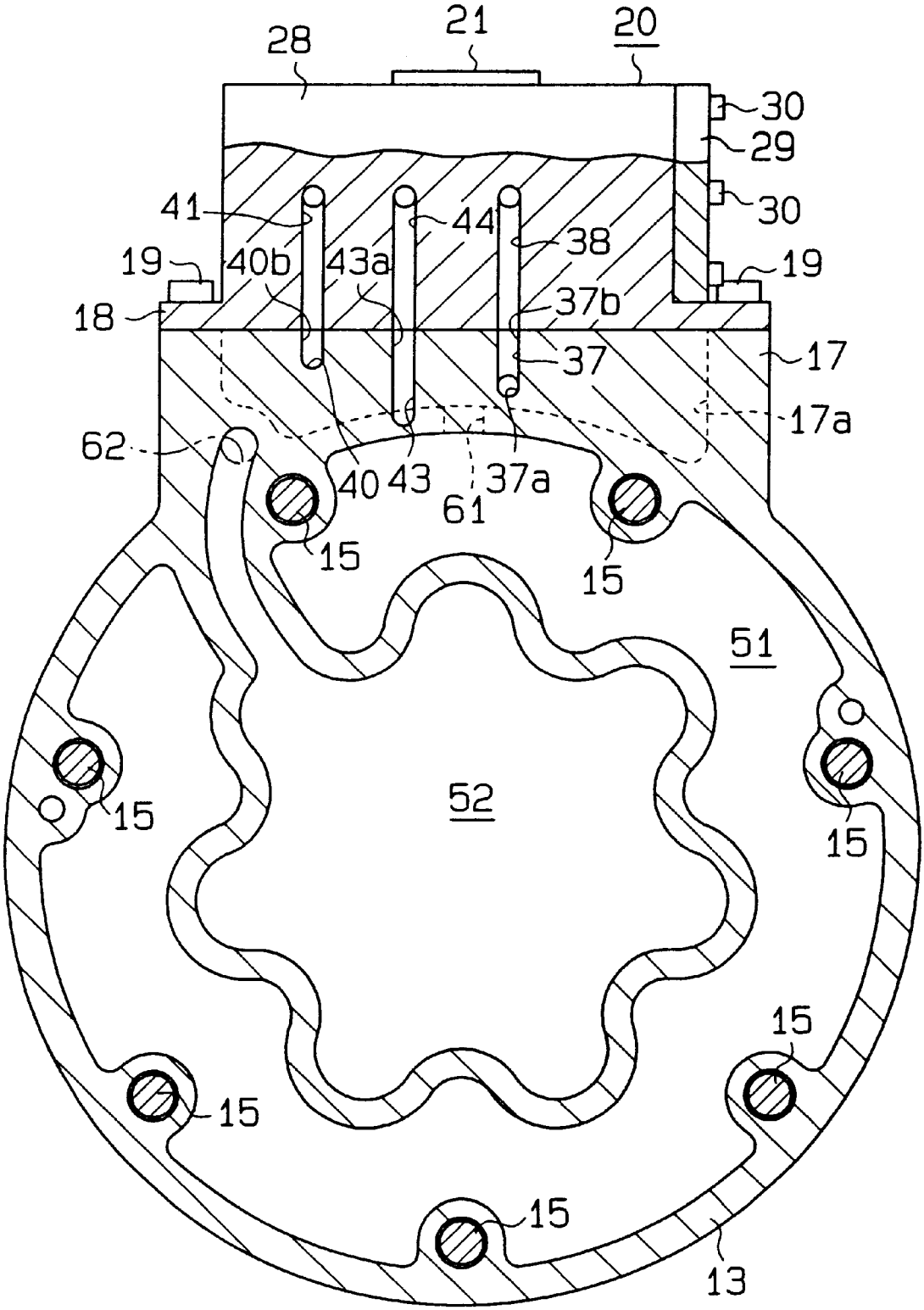
FIG. 6 is a cross-sectional view taken along line 6—6 of FIG. 5.
Figure 7:
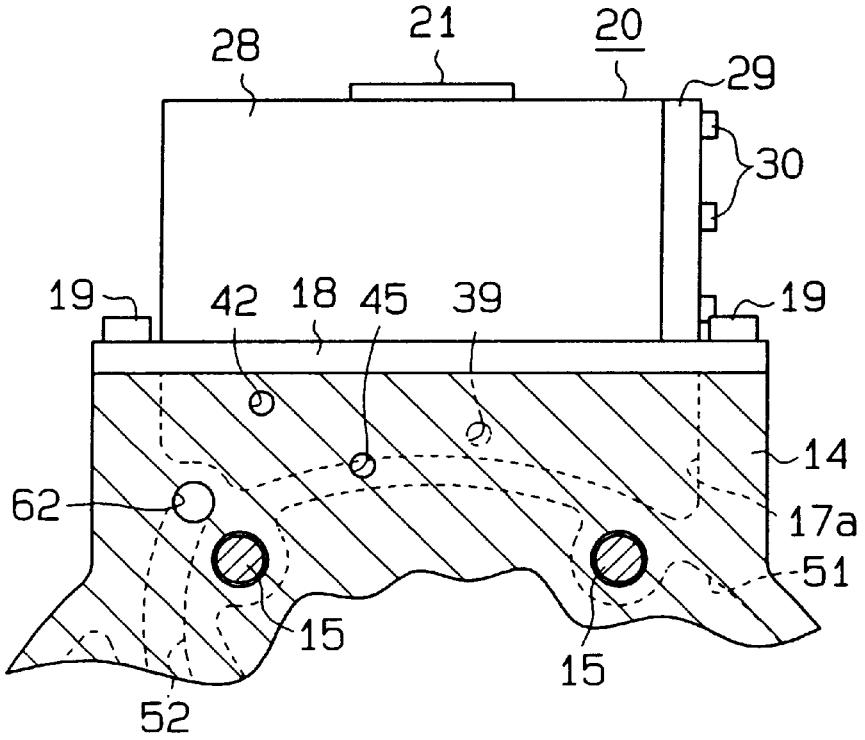
FIG. 7 is a cross-sectional view taken along line 7—7 of FIG. 5.
Figure 8:
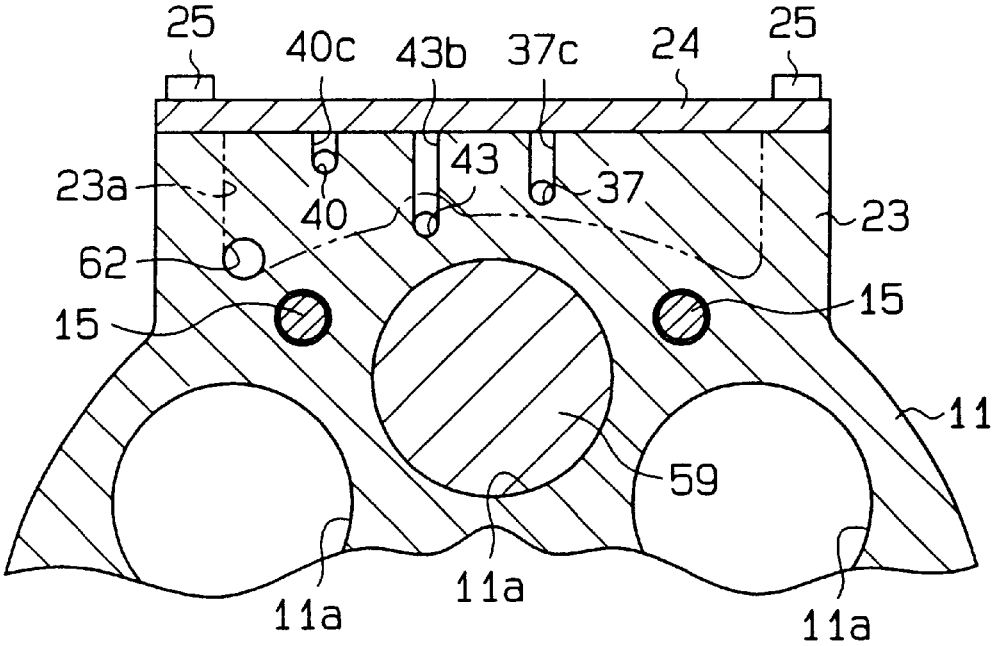
FIG. 8 is a cross-sectional view taken along line 8—8 of FIG. 5.

(4) As illustrated with alternate long and two short dashes lines in FIG. 5, the cover 18 of the suction muffler 17 and the cover 24 of the discharge muffler 23 may be formed integrally.

(5) The muffler on which the displacement control valve 20 is not mounted has a cover that blocks the inlet port or the outlet port of the communicating passages 37, 40, 43, which open at the upper end of the side walls of the muffler. Therefore, there is thus no harm in forming all the bores 39, 42, 45 regardless of the mounting location of the control valve 20.

(6) The present invention may be embodied in a variable displacement compressor of the type in which pistons are coupled to a wobble plate serving as a drive plate by rods.

We claim:

1. A variable displacement compressor to be used with a refrigeration circuit comprising:

a body for compressing gas drawn from the refrigeration circuit and for discharging compressed gas to the refrigeration circuit;

the body defining a suction chamber through which gas is drawn from the refrigeration circuit into the body and a discharge chamber through which compressed gas is discharged from the body to the refrigeration circuit;

a muffler on the body for connection to the refrigeration circuit, the muffler being in flow communication with one of the suction chamber and the discharge chamber for reducing pulsation of the gas, the muffler having a cover connected to the muffler; and a displacement control valve for controlling displacement of the compressor, wherein the displacement control valve is mounted on the muffler cover.

2. The compressor of claim 1, wherein the muffler has a chamber for conducting refrigerant gas, and wherein the chamber has an opening that opens to the exterior of the body, and the cover covers and closes the opening when the cover is connected to the muffler.

3. The compressor of claim 2, wherein the muffler is a suction muffler for conducting refrigerant gas from the refrigeration circuit into the suction chamber.

4. The compressor of claim 3, wherein the cover has a connection port for connecting the refrigeration circuit to the suction muffler.

5. The compressor of claim 2, wherein the muffler is a discharge muffler for conducting refrigerant gas from the discharge chamber to the refrigeration circuit.

6. The compressor of claim 5, wherein the cover has a connection port for connecting the refrigeration circuit to the discharge muffler.

7. The compressor of claim 1, wherein the compressor body includes:

a crank chamber;

a rotatable shaft passing through the crank chamber;

an inclinable drive plate located in the crank chamber and mounted on the rotatable shaft, wherein the inclination of the drive plate with respect to the axis of the rotatable shaft is variable;

a cylinder bore;

a piston operably connected to the drive plate and located in the cylinder bore;

a suction chamber through which gas is drawn by the piston into the compressor; and a discharge chamber through which gas is discharged from the compressor, wherein the inclination of the drive plate with respect to the rotatable shaft is varied based on the difference between the pressure in the suction chamber and that in the crank chamber, and wherein the stroke of the piston changes in accordance with the change in the inclination of the drive plate, thus varying the displacement of the compressor.

8. The compressor of claim 7, wherein the displacement control valve controls the displacement by controlling the pressure in the crank chamber.

9. The compressor of claim 8, wherein the displacement control valve controls the pressure in the crank chamber based on the pressure in the suction chamber.

10. The compressor of claim 9, wherein the muffler includes a suction muffler and a discharge muffler, a first passage is formed between the suction muffler and the control valve, a second passage is formed between the discharge muffler and the control valve, and a third passage is formed between the crank chamber and the control valve.

11. The compressor of claim 9, wherein said at least one passage has a port opening at the surface of the compressor body and a second port opening at the surface of the cover.

12. The compressor of claim 9, wherein a first passage is formed between the control valve and the suction chamber, a second passage is formed between the control valve and the discharge chamber, and a third passage is formed between the control valve and the crank chamber.

13. The compressor of claim 12, wherein the first passage includes a first communicating passage formed in the compressor body and a corresponding first supply passage formed in the displacement control valve;

the second passage includes a second communicating passage formed in the compressor body and a corresponding second supply passage formed in the control valve;

the third passage includes a third communicating passage formed in the compressor body and a corresponding third supply passage formed in the control valve;

each of the communicating passages has a port opening to the exterior surface of the muffler at a location covered by the cover;

each of the supply passages has a port opening to the exterior of the cover at a location facing the muffler; and mounting the cover to the muffler connects the supply passages to the corresponding communicating passages.

14. The compressor of claim 13, wherein the muffler is a suction muffler that conducts gas into the compressor from the refrigerant circuit.

15. The compressor of claim 14, wherein the compressor additionally has a discharge muffler including an exterior opening that opens to the exterior of the body, and wherein the exterior opening is covered by a plate having a discharge port formed thereon, wherein the discharge muffler conducts gas from the discharge chamber to the refrigerant circuit.

16. The compressor of claim 13, wherein the muffler is a discharge muffler that conducts gas from the discharge chamber to the refrigerant circuit.

17. The compressor of claim 16, wherein the compressor additionally has a suction muffler that includes an exterior opening that opens to the exterior of the body, wherein the exterior opening is covered by a plate having an intake port formed thereon, wherein the suction muffler conducts gas from the refrigerant circuit to the suction chamber.

18. A variable displacement compressor to be used with a refrigeration circuit comprising:

a body for compressing gas drawn from the refrigeration circuit and for discharging compressed gas to the refrigeration circuit;

a muffler on the body for connection to the refrigeration circuit for reducing pulsation of the gas, the muffler having an exterior opening that opens to the exterior of the body, wherein the exterior opening is covered by a separate cover connected to the muffler;

a displacement control valve for controlling displacement of the compressor, wherein the displacement control valve is mounted on the muffler cover;

a crank chamber defined by the body;

a rotatable shaft passing through the crank chamber;

an inclinable drive plate located in the crank chamber and mounted on the rotatable shaft, wherein the inclination of the drive plate with respect to the axis of the rotatable shaft is variable;

a cylinder bore defined in the body;

a piston operably connected to the drive plate and located in the cylinder bore;

a suction chamber defined in the body through which gas is drawn by the piston into the compressor; and a discharge chamber defined in the body through which gas is discharged from the compressor, wherein the inclination of the drive plate with respect to the rotatable shaft is varied based on the difference between the pressure in the suction chamber and the pressure in the crank chamber, and the stroke of the piston changes in accordance with the change in the inclination of the drive plate, thus varying the displacement of the compressor;

the muffler being in flow communication with at least one of the suction chamber and the discharge chamber.

19. A variable displacement compressor to be used with a refrigeration circuit comprising:

a body for compressing gas drawn from the refrigeration circuit and for discharging compressed gas to the refrigeration circuit;

a crank chamber defined by the body;

a rotatable shaft passing through the crank chamber;

an inclinable drive plate located in the crank chamber and mounted on the rotatable shaft, wherein the inclination of the drive plate with respect to the axis of the rotatable shaft is variable;

a cylinder bore defined in the body;

a piston operably connected to the drive plate and located in the cylinder bore;

a suction chamber defined in the body through which gas is drawn by the piston into the compressor;

a discharge chamber defined in the body through which gas is discharged from the compressor, wherein the inclination of the drive plate with respect to the rotatable shaft is varied based on the difference between the pressure in the suction chamber and the pressure in the crank chamber, and wherein the stroke of the piston changes in accordance with the change in the inclination of the drive plate, thus varying the displacement of the compressor;

a discharge muffler connected to the discharge chamber and for connection to the refrigeration circuit for reducing pulsation of the gas, the discharge muffler having an exterior opening that opens to the exterior of the body;

a suction muffler connected to the suction chamber and for connection to the refrigeration ciruit for reducing pulsation of the gas, the suction muffler having an exterior opening that opens to the exterior of the body;

a pair of muffler covers, each having a port for connecting the refrigeration circuit thereto, one muffler cover covering the discharge muffler opening and the other covering the suction muffler opening; and a displacement control valve for controlling displacement of the compressor, wherein the displacement control valve is mounted on one of the muffler covers.

* * * * *

UNITED STATES PATENT AND TRADEMARK OFFICE

CERTIFICATE OF CORRECTION

PATENT NO. : 5,971,716
APPLICATION NO. : 08/776563
DATED : October 26, 1999
INVENTOR(S) : Masaki Ota et al.

It is certified that error appears in the above-identified patent and that said Letters Patent is hereby corrected as shown below:

Column 2, line 45, after "FIG. 1" change "." (a period) to --;-- (a semicolon).

Column 5, line 25, after "of" and before "outlet", insert --FIGS. 1-8, the--.

Column 6, line 2, after "The" delete "above".

Column 11, line 34 and 35, delete "wherein said at least one passage has" and insert therefor: --comprising at least one passage between the compressor body and the displacement control valve for conducting gas for the functioning of the displacement control valve, the at least one passage having--.

Signed and Sealed this

Eighth Day of August, 2006

JON W. DUDAS
*Director of the United States Patent and Trademark Office*